United States Patent [19]

Militello

[11] Patent Number: 4,475,698

[45] Date of Patent: Oct. 9, 1984

[54] APPARATUS FOR COILING A FLEXIBLE MEMBER

[76] Inventor: Jimmy Militello, Rte. 2, Box 2994, Plant City, Fla. 33566

[21] Appl. No.: 354,611

[22] Filed: Mar. 4, 1982

[51] Int. Cl.[3] ..... B65H 75/40

[52] U.S. Cl. ..... 242/86; 242/96

[58] Field of Search ..... 242/86, 96, 84.8, 86.1, 242/106; 137/355.16, 355.17, 355.20, 355.26, 355.28; 135/68

[56] References Cited

U.S. PATENT DOCUMENTS

| | | | |
|---|---|---|---|
| 1,499,644 | 7/1924 | Dowrelio | 242/86 |
| 2,717,129 | 9/1955 | McDonald | 242/96 X |
| 3,445,066 | 5/1969 | Mohar | 242/86 X |
| 3,637,158 | 1/1972 | Jacobsen | 242/96 |
| 3,827,097 | 8/1974 | Hamann | 242/86 X |
| 4,237,915 | 12/1980 | Zabielski et al. | 135/68 |

*Primary Examiner*—Stuart S. Levy
*Assistant Examiner*—David Werner
*Attorney, Agent, or Firm*—Stefan Stein

[57] ABSTRACT

An apparatus for coiling a flexible member such as a hose. The coiling apparatus comprises a coil mechanism which is located at the distal end of an elongated body member. The coil mechanism is designed to receive the end of the hose and to coil the hose upon rotation of the coil mechanism. The coil mechanism comprises a rotatable base plate having three projections extending therefrom for receiving the end of the hose and to initiate and then continue coiling of the hose.

2 Claims, 6 Drawing Figures

APPARATUS FOR COILING A FLEXIBLE MEMBER

BACKGROUND OF THE INVENTION

This invention relates to an apparatus for coiling a flexible member such as a hose.

Presently there exists a need in the firefighting industry for an apparatus for coiling water hoses. More specifically, in fighting a fire, several hundred to a couple of thousand feet of hose will be laid out and used by the firefighters. After the fire is extinguished, each section of hose must be rolled into a coil for transport back to the firefighting station where the sections of hose will be washed and dried for later use. Obviously, after the firefighters have fought a long and exhausting fire, they do not welcome the chore of having to physically bend over and roll each individual section of the hose. Accordingly, the need for an apparatus for coiling the hoses is well-appreciated by firefighters.

Therefore, it is an object of this invention to provide an apparatus which enables a firefighter to almost effortlessly coil each section of hose from an erect position thereby eliminating the effort of bending over and manually coiling each section of hose.

Another object of this invention is to provide an apparatus for coiling a hose which includes a coil mechanism particularly designed for coiling a relatively flat hose such as a firefighting hose.

Another object of this invention is to provide an apparatus for coiling a hose wherein the coil mechanism thereof includes means for initiating the coiling of the hose such that the hose is wound in a tight and compact manner.

Another object of this invention is to provide an apparatus for coiling a hose wherein the means for rotating the coil mechanism may be operated manually with little effort on the part of the firefighter.

Another object of this invention is to provide an apparatus for coiling a hose including a handle means which permits the firefighter to comfortably grasp the apparatus and operate the same.

Another object of this invention is to provide an apparatus for coiling a hose wherein the handle means comprises a grip and a forearm cradle for receiving the forearm of the firefighter.

Another object of this invention is to provide an apparatus for coiling a hose wherein the forearm cradle of the handle means includes a U-shaped configuration enabling the forearm of the firefighter to be placed therein even when the firefighter is dressed in bulky clothes.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an apparatus for coiling a flexible member such as a hose. More particularly, the hose roller of the invention comprises a coil mechanism which is located at the distal end of an elongated body member. The coil mechanism is designed to receive the end of the hose and to coil the hose upon rotation of the coil mechanism. The coil mechanism comprises a journal shaft which is rotatably journalled to the end of the elongated body member. The end of the journal shaft is rigidly connected to a base plate. A first and second projection extend from the lower and upper portions, respectively, of one edge of the base plate. A third projection extends from the lower portion of the opposite edge of the base plate. All of the projections extend at right angles from the plane of the base plate on the side opposite to that which the journal shaft is connected. The first and second projections are spaced sufficiently apart to permit the end of the hose to be inserted therebetween. The third projection functions to fold-over the coupling of the hose to initiate the coiling of the hose. Further rotation of the coil mechanism causes the hose to be tightly wound in a coil. The projections are then slipped from between the end of the coiled hose after use.

The means for rotating the coil mechanism comprises a crank mechanism which is operatively connected to the coil mechanism by means of an endless chain. The crank mechanism includes a crank, a crankshaft rotatably journalled to the mid-portion of the elongated body member, and a crank handle. A sprocket is connected to the crankshaft of the crank mechanism, and another sprocket is similarly connected to the journal shaft of the coil mechanism. The endless chain is positioned about the sprockets and properly tensioned such that rotation of the crank handle of the crank mechanism causes the coil mechanism to also rotate thereby coiling the hose.

Handle means are provided to permit the operator to comfortably grip the hose roller and operate the same. Specifically, the handle means comprises a grip which extends from the upper surface of the elongated body member, and a forearm cradle which is connected to the proximal end of the elongated body member. The grip is positioned relative to the cradle to permit the forearm of the operator to be comfortably seated within the forearm cradle when the hand of the operator grips the grip.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
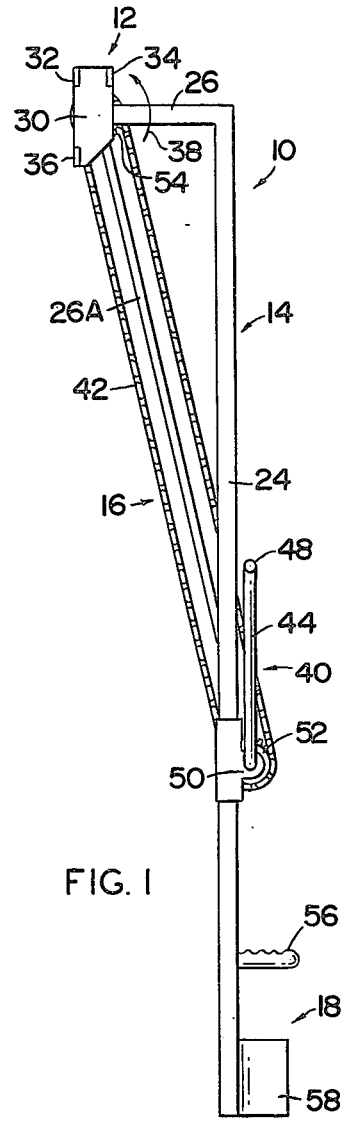
FIG. 1 is a top view of the hose roller of the invention.
Figure 2:
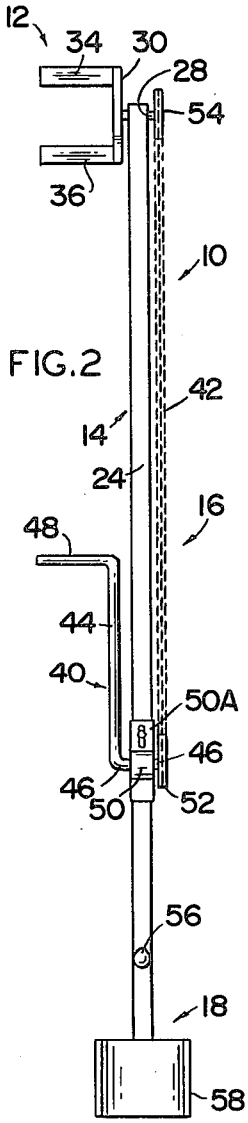
FIG. 2 is a left side view of FIG. 1 illustrating the crank mechanism which rotates the coil mechanism for coiling the hose.
Figure 3:
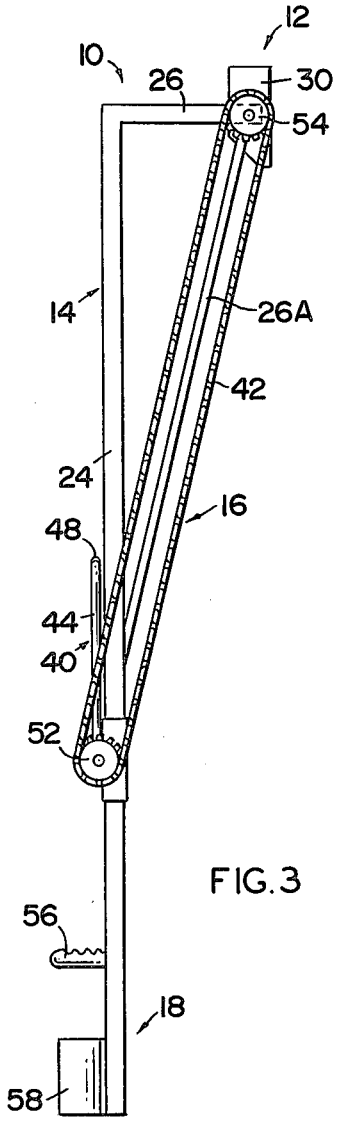
FIG. 3 is a right side view of FIG. 1 illustrating the endless chain which interconnects the crank mechanism and the coil mechanism.

As shown in FIGS. 1, 2, and 3, the hose roller 10 of the invention basically comprises a coil mechanism 12 connected to the distal end of an elongated body member 14. Rotation means, generally indicated by numeral 16, is provided for rotating the coil mechanism 12. Handle means, generally indicated by numeral 18, is provided for permitting an operator to grasp the hose roller 10 and operate the same. During use, the coil mechanism 12 is positioned to engage the end of a hose 20 such as a collapsible firefighting water hose. Upon initial rotation of the coil mechanism 12 by the rotation means 16, the coupling 22 of the hose 20 is folded over thereby initiating the coiling of the hose 20. Further rotation of the coil mechanism 12 causes further coiling of the hose 20 until the hose 20 is completely coiled to form a coiled bundle, at which time, the coil mechanism 12 may be slipped out from its engaging position with the end of the hose 20.

More particularly, the elongated body member 14 of the hose roller 10 is manufactured from a relatively long length of stock material 24 such as a round or rectangular steel conduit. Preferably, an extension 26 is rigidly connected, as by welding, to the terminal end of the stock material 24 at a right angle relationship thereto such that the elongated body member 14 comprises an L configuration. A cross member 26A interconnects the stock material 24 and the extension 26 to add rigidity to the body member 14.

The coil mechanism 12 of the hose roller 10 comprises a journal shaft 28 which is rotatably positioned through the distal end of the extension 26 by means of a bearing (not shown). The end of the shaft 28 extending from the left side of the extension 26 is rigidly connected to a base plate 30 such as by welding. A first and a second projection 32 and 34 are rigidly connected to the base plate 30 and are sufficiently spaced apart from one another to permit the hose 20 to be inserted therebetween. Accordingly, rotation of the journal shaft 28 by the rotation means 16 causes the base plate 30 to also rotate thereby forcing the hose 20 to be twisted to initiate and continue with the coiling of the hose 20.

Figure 4:
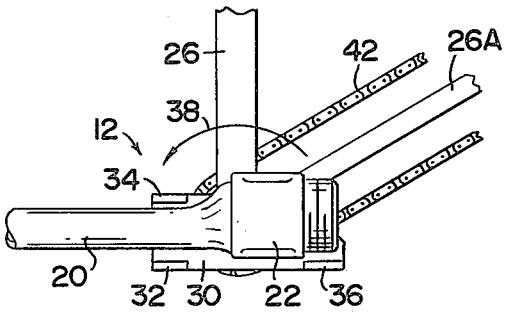
FIG. 4 is an enlarged partial view of FIG. 2 illustrating the projections and the base plate of the coil mechanism.
Figure 5:
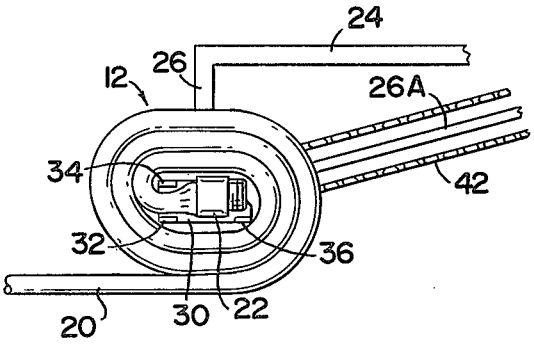
FIG. 5 is a partial view of the hose roller illustrating the function of the third projection of the coil mechanism in folding the coupling of the hose to initiate the coiling of the hose.

It should be appreciated that in order to tightly coil the hose 20, it is necessary to initiate the coiling of the hose 20 at the end thereof, rather than an appreciable distance from the end. The coil mechanism 12 may include a third projection 36 which is similarly rigidly connected to the base plate 30 (see FIGS. 3 and 4). As shown, the first and second projections 32 and 34 extend normally from the lower and upper portions, respectively, of the forward edge of the base plate 30. Similarly, the third projection 36 extends normally from the lower portion of the rearward edge of the base plate 30. Each of the projections 32, 34, and 36 are preferably manufactured from a flat rigid material. Further, the projections 32, 34, and 36 are preferably connected to the base plate 30 such that the first and the third projections 32 and 36 are coplanar, and the second projection 34 is positioned apart and parallel to the plane of the first and third projections 32 and 36 a distance sufficient to permit the hose 20 to be inserted between the second projection 34 and the first and third projections 32 and 36. During use, the coil mechanism 12 of the hose roller 10 is positioned at the very end of the hose 20 such that the coupling 22 of the hose 20 rests on, or is close to, the third projection 36 (see FIG. 4). As the coil mechanism 12 is rotated in the direction shown by arrow 38, the third projection 36 forces the coupling 22 to fold over the length of the hose 20 thereby initiating the coiling of the hose 20. Once initiated, further rotation of the coil mechanism 12 causes the hose 20 to be wound in a right and compact coil. As mentioned previously, when the hose 20 is completely coiled, the projections 32, 34, and 36 are easily slipped from their engaging position with the end of the hose 20.

The rotation means 16 functions to rotate the coil mechanism 12. In the preferred embodiment, the rotation means 16 comprises a crank mechanism 40 and an endless chain 42 which interconnects the crank mechanism 40 and the coil mechanism 12. More particularly, the crank mechanism 40 includes a crank 44, a crankshaft 46, and a crank handle 48. The crank handle 48 extends at a right angle from the end of the crank 44, and may include a rotatable sleeve (not shown) positioned thereabout to provide a comfortable grip for the operator of the hose roller 10. The crankshaft 46 extends through a journal bearing 50. A sprocket 52 is then connected to the end of the crankshaft 46. Another sprocket 54 is similarly connected to the end of the journal shaft 28 of the coil mechanism 12. The endless chain 42 is then fitted about the two sprockets 52 and 54. Accordingly, it is readily seen that rotation of the crank 44 causes rotation of the journal shaft 28 which in turn rotates the coil mechanism 12 to coil the hose 20. It is noted that the base 50A of the journal bearing 50 may be slotted such that the journal bearing 50 is adjustably connected (longitudinally) to the elongated body member 14 thereby permitting the tension in the endless chain 42 to be adjusted.

It is noted that many other rotation means 16 may be substituted for the crank mechanism 40 described above without departing from the spirit and scope of this invention. For example, a low speed, high torque motor (not shown) may be connected to the body member 14 to rotate the endless chain 42 thereby rotating the coil mechanism 12. Alternatively, the motor may be connected to the distal end of the elongated body member 14 such that the output shaft of the motor is connected directly, or by appropriate gearing, to the journal shaft 28 of the coil mechanism 12. It should also be appreciated that the sprockets 52 and 54 and the endless chain 42 may alternatively comprise a belt and pulley arrangement (not shown), which would operate substantially identical to the endless chain 42 described above. However, it may be necessary to spring-load the journal bearing 50 such that the belt is always properly tensioned.

Figure 6:
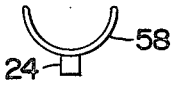
FIG. 6 is a partial end view of FIG. 2 illustrating the U-shaped forearm cradle designed to receive the forearm of the operator using the hose roller of the invention.

Finally, the handle means 18 comprises a grip 56 which extends upwardly from the elongated body member 14. The handle means 18 further includes a forearm cradle 58 which is rigidly connected to the proximal end of the elongated body member 14. As shown in FIG. 6, the forearm cradle 58 is preferably U-shaped for comfortably receiving the forearm of the operator. The grip 56 is positioned along the body member 14 from the forearm cradle 58 a distance which permits the forearm of the operator to be comfortably seated within the forearm cradle 58 when the hand of the operator grips the grip 56. Also, the relative position of the journal bearing 50 of the crank mechanism 40 (and correspondingly the length of the endless chain 42) and the length of the crank 44 is selected to facilitate the rotating of the crank mechanism 40 by the operator as the operator grasps the grip 56 of the handle means 18. The handle means 18 may comprise any other embodiment which permits the operator to comfortably grip and operate the hose roller 10.

The above description has, with a certain degree of particularity, described the hose roller 10 for use in coiling a relatively flat hose such as a firefighting water hose. It shall be understood that the hose roller 10 functions as an apparatus for coiling virtually any type of a flexible member, and therefore can be used in a large variety of applications.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. An apparatus for coiling a flexible member such as a hose, comprising in combination:

an elongated body member;

a coil mechanism located at the distal end of said elongated body member for coiling the flexible member upon rotation of said coil mechanism;

said coil mechanism comprising a first, a second and a third projection extending substantially parallel to one another with said first projection and said second projection being sufficiently spaced apart to permit the flexible member to be inserted therebetween and with said third projection being spaced rearwardly from said first projection to initiate coiling of the flexible member upon rotation of said coil mechanism;

means for rotating said coil mechanism comprising, in combination:

a crank mechanism located at the mid-portion of said elongated body member and an endless flexible member interconnecting said crank mechanism and said coil mechanism such that said coil mechanism is rotated upon rotation of said crank mechanism; and handle means for permitting an operator to grasp the apparatus and operate the same to coil the flexible member comprising, in combination:

a grip extending from said elongated body member, a forearm cradle positioned at the proximal end of said elongated body member; and said grip member extending from said elongated body member being positioned relative to said forearm cradle to permit the forearm of the operator to be comfortably seated within said forearm cradle when the hand of the operator grips said grip.

2. An apparatus for coiling a collapsible hose, comprising in combination:

an elongated body member;

a coil mechanism located at the distal end of said elongated body member, said coil mechanism comprising a base plate, a journal shaft rotatably journalled at the distal end of said elongated body member, one end of said journal shaft being rigidly connected to the center of said base plate, a first and a second projection extending from the lower and upper portions, respectively, of one edge of said base plate, a third projection extending from the lower portion of the opposite edge of said base plate, and said projections extending normally from the plane of said base plate on the side opposite to that which said journal shaft is connected;

means for rotating said base plate of said coil mechanism, said rotation means comprising a crank mechanism including a crank, a crankshaft rotatably journalled to said elongated body member, and a crank handle, a sprocket connected to the end of said crankshaft, another sprocket connected to the end of said journalled shaft, and an endless chain interconnecting said sprockets; and a handle means for permitting an operator to grasp the apparatus and operate the same to coil the hose, said handle means comprising a forearm cradle positioned at the proximal end of said elongated body member, and a grip extending from said elongated body member in close proximity to said forearm cradle.

* * * * *